US010976099B1

(12) United States Patent
Weaver

(10) Patent No.: US 10,976,099 B1
(45) Date of Patent: Apr. 13, 2021

(54) LOCKING SHELF INSERT FOR USE WITH A REFRIGERATOR OR FREEZER

(71) Applicant: Eric Weaver, Oxford, PA (US)

(72) Inventor: Eric Weaver, Oxford, PA (US)

( * ) Notice: Subject to any disclaimer, the term of this patent is extended or adjusted under 35 U.S.C. 154(b) by 0 days.

(21) Appl. No.: 16/787,178

(22) Filed: Feb. 11, 2020

(51) Int. Cl.
*F25D 25/02* (2006.01)
*F25D 25/00* (2006.01)
*A47G 29/20* (2006.01)

(52) U.S. Cl.
CPC ..... *F25D 25/005* (2013.01); *A47G 29/20* (2013.01); *F25D 25/02* (2013.01); *F25D 2325/021* (2013.01); *F25D 2500/00* (2013.01)

(58) Field of Classification Search
CPC ..... F25D 25/00; F25D 25/02; F25D 25/005; F25D 25/021; F25D 25/022; A47B 88/407; A47G 29/20
USPC ..... 312/401, 404, 408, 297
See application file for complete search history.

(56) References Cited

U.S. PATENT DOCUMENTS 1,774,312 A * 8/1930 Braeutigam ..... F25D 25/021 62/382
1,857,522 A * 5/1932 Ungeheuer ..... A47B 13/16 220/8
2,168,022 A * 8/1939 Drager ..... E06B 9/115 160/231.2
2,267,664 A * 12/1941 Myers ..... F25D 23/025 312/291
2,498,562 A * 2/1950 Long ..... F25D 23/025 62/246
2,597,267 A * 5/1952 Shoemaker ..... F25D 11/02 62/329
3,339,994 A 9/1967 Reddig
4,217,012 A * 8/1980 Klaus ..... A47B 55/06 312/111
4,413,489 A * 11/1983 Hogue ..... E05B 65/0864 70/81
6,811,235 B1 11/2004 Brunette
7,918,362 B2 4/2011 Schmitt
D669,921 S 10/2012 Kinser
8,651,598 B2 * 2/2014 Go ..... F25D 25/005 312/404
2003/0051645 A1 3/2003 Rigatuso
(Continued)

FOREIGN PATENT DOCUMENTS

EP 2565566 12/2018
GB 1059950 * 2/1967 ..... A47B 88/407

*Primary Examiner* — James O Hansen
(74) *Attorney, Agent, or Firm* — Kyle A. Fletcher, Esq.

(57) ABSTRACT

The locking shelf insert for use with a refrigerator or freezer is configured for use with a storage device selected from the group consisting of a refrigerator and a freezer. The selected storage device further comprises a storage shelf. The locking shelf insert for use with a refrigerator or freezer is a barrier structure that attaches to the storage shelf. The locking shelf insert for use with a refrigerator or freezer forms a barricade that controls access into the storage space provided by the storage shelf. The locking shelf insert for use with a refrigerator or freezer comprises a first shell, a second shell, and a door structure. The first shell, the second shell, and the third shell combine to form the barricade such that the form factor of the barricade is adjustable. The door structure provides access into the protected storage space formed by the barricade.

15 Claims, 7 Drawing Sheets

(56) References Cited

U.S. PATENT DOCUMENTS

| | | | | |
|---|---|---|---|---|
| 2003/0080656 | A1* | 5/2003 | Chen | E06B 9/115<br>312/297 |
| 2009/0191022 | A1 | 7/2009 | Meiser | |
| 2010/0259139 | A1* | 10/2010 | Tussy | F25D 25/005<br>312/213 |
| 2013/0111936 | A1 | 5/2013 | Olson | |

* cited by examiner

LOCKING SHELF INSERT FOR USE WITH A REFRIGERATOR OR FREEZER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of mechanical engineering including general construction features of refrigerators, more specifically, a constructional detail of a refrigerator. (A25D23/28)

SUMMARY OF INVENTION

The locking shelf insert for use with a refrigerator or freezer is a mechanical device. The locking shelf insert for use with a refrigerator or freezer is configured for use with a storage device selected from the group consisting of a refrigerator and a freezer. The selected storage device further comprises a storage shelf. The locking shelf insert for use with a refrigerator or freezer is a barrier structure that attaches to the storage shelf of the selected device. The locking shelf insert for use with a refrigerator or freezer is a lockable structure. The locking shelf insert for use with a refrigerator or freezer forms a barricade that controls access into the storage space provided by the storage shelf selected for attachment. The locking shelf insert for use with a refrigerator or freezer comprises a first shell, a second shell, and a door structure. The first shell, the second shell, and the third shell combine to form the barricade such that the form factor of the barricade is adjustable. The door structure provides access into the protected storage space formed by the barricade.

These together with additional objects, features and advantages of the locking shelf insert for use with a refrigerator or freezer will be readily apparent to those of ordinary skill in the art upon reading the following detailed description of the presently preferred, but nonetheless illustrative, embodiments when taken in conjunction with the accompanying drawings.

In this respect, before explaining the current embodiments of the locking shelf insert for use with a refrigerator or freezer in detail, it is to be understood that the locking shelf insert for use with a refrigerator or freezer is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the locking shelf insert for use with a refrigerator or freezer.

It is therefore important that the claims be regarded as including such equivalent construction insofar as they do not depart from the spirit and scope of the locking shelf insert for use with a refrigerator or freezer. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
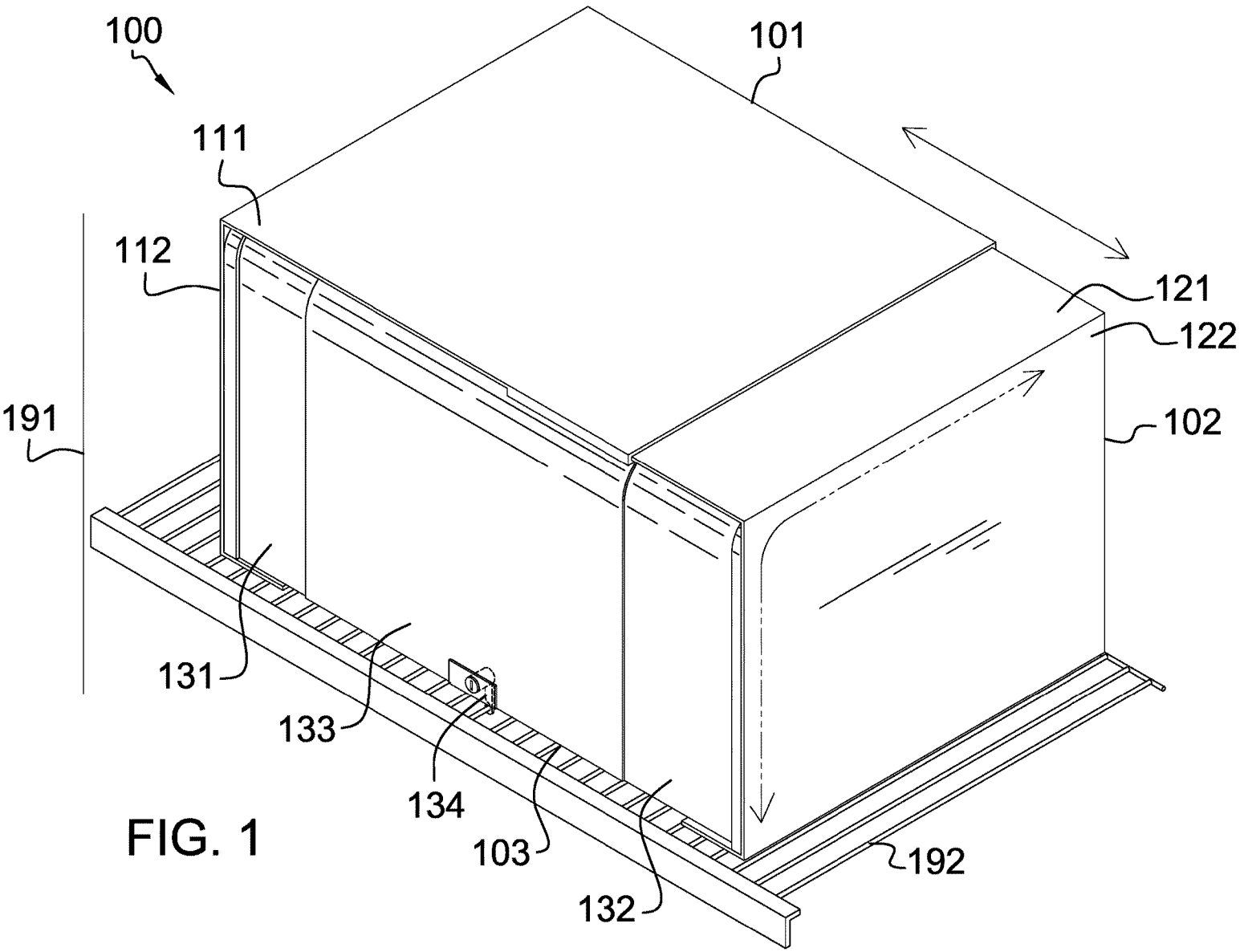
FIG. 1 is a perspective view of an embodiment of the disclosure.
Figure 2:
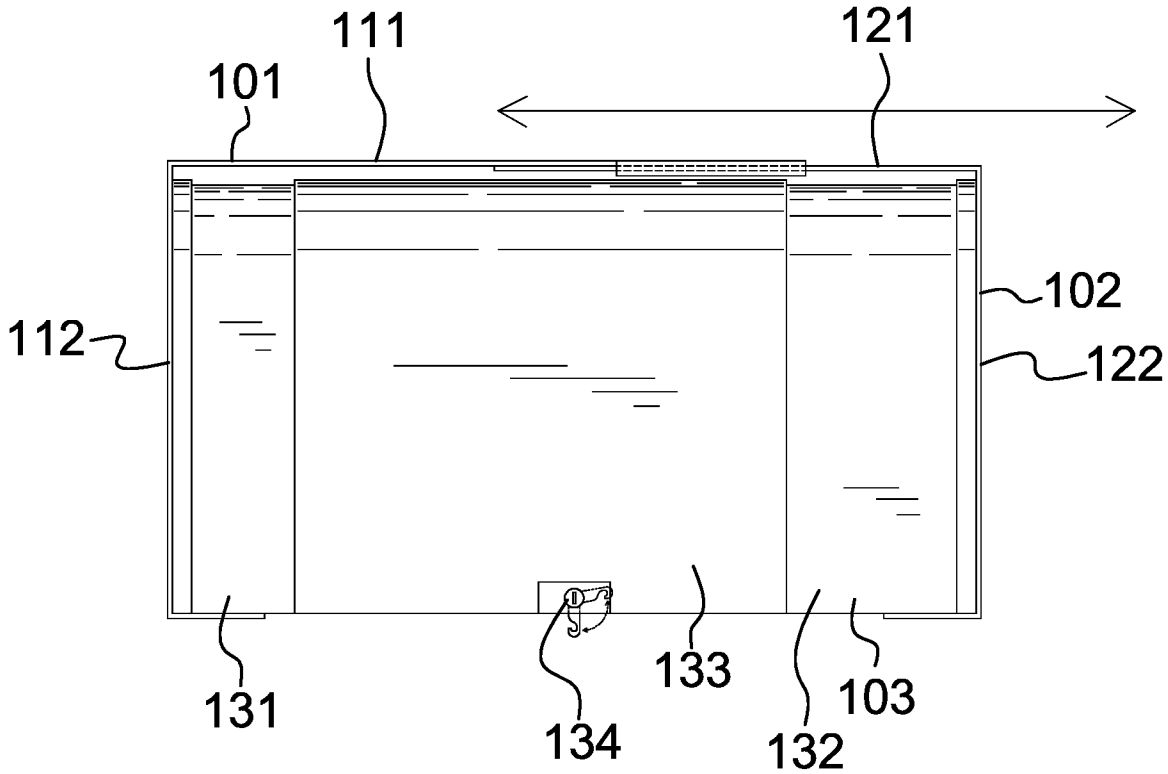
FIG. 2 is a front view of an embodiment of the disclosure.
Figure 3:
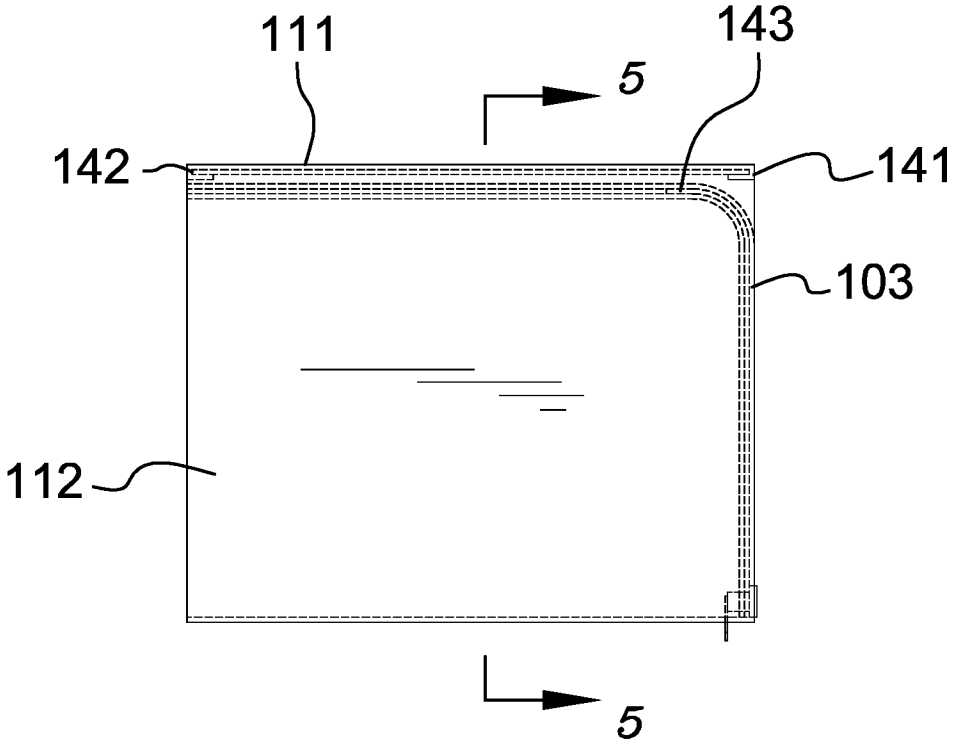
FIG. 3 is a side view of an embodiment of the disclosure.
Figure 4:
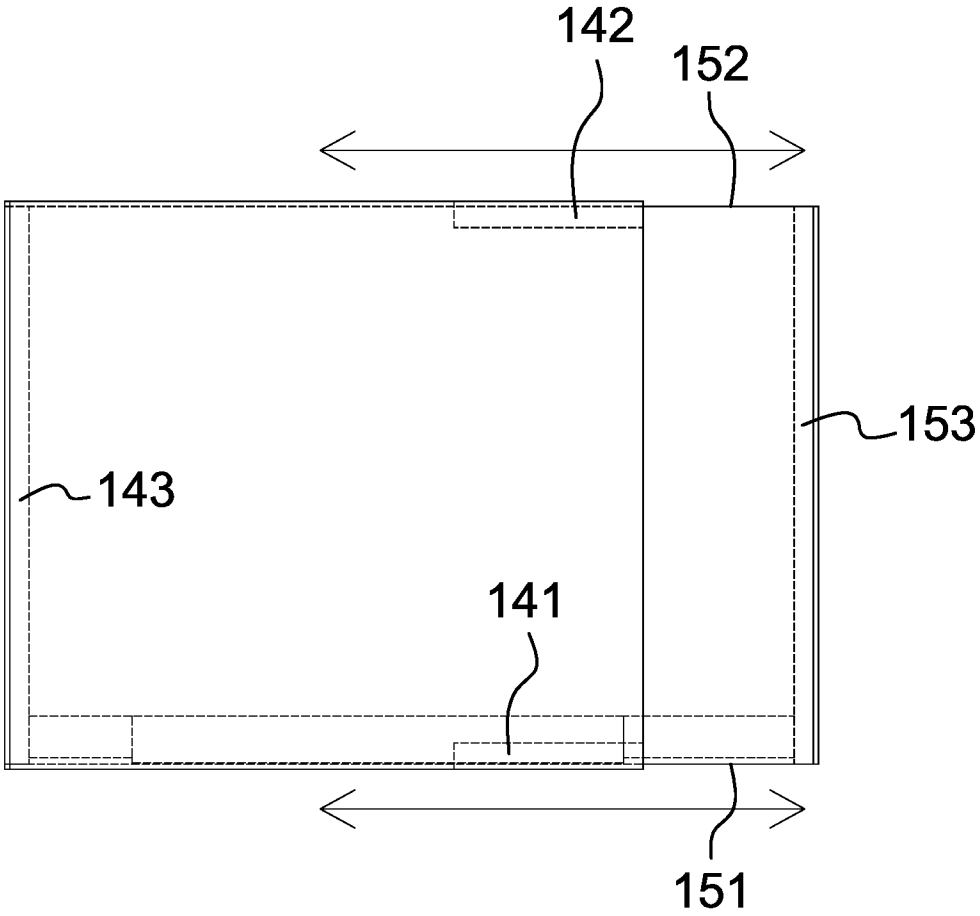
FIG. 4 is a top view of an embodiment of the disclosure.
Figure 5:
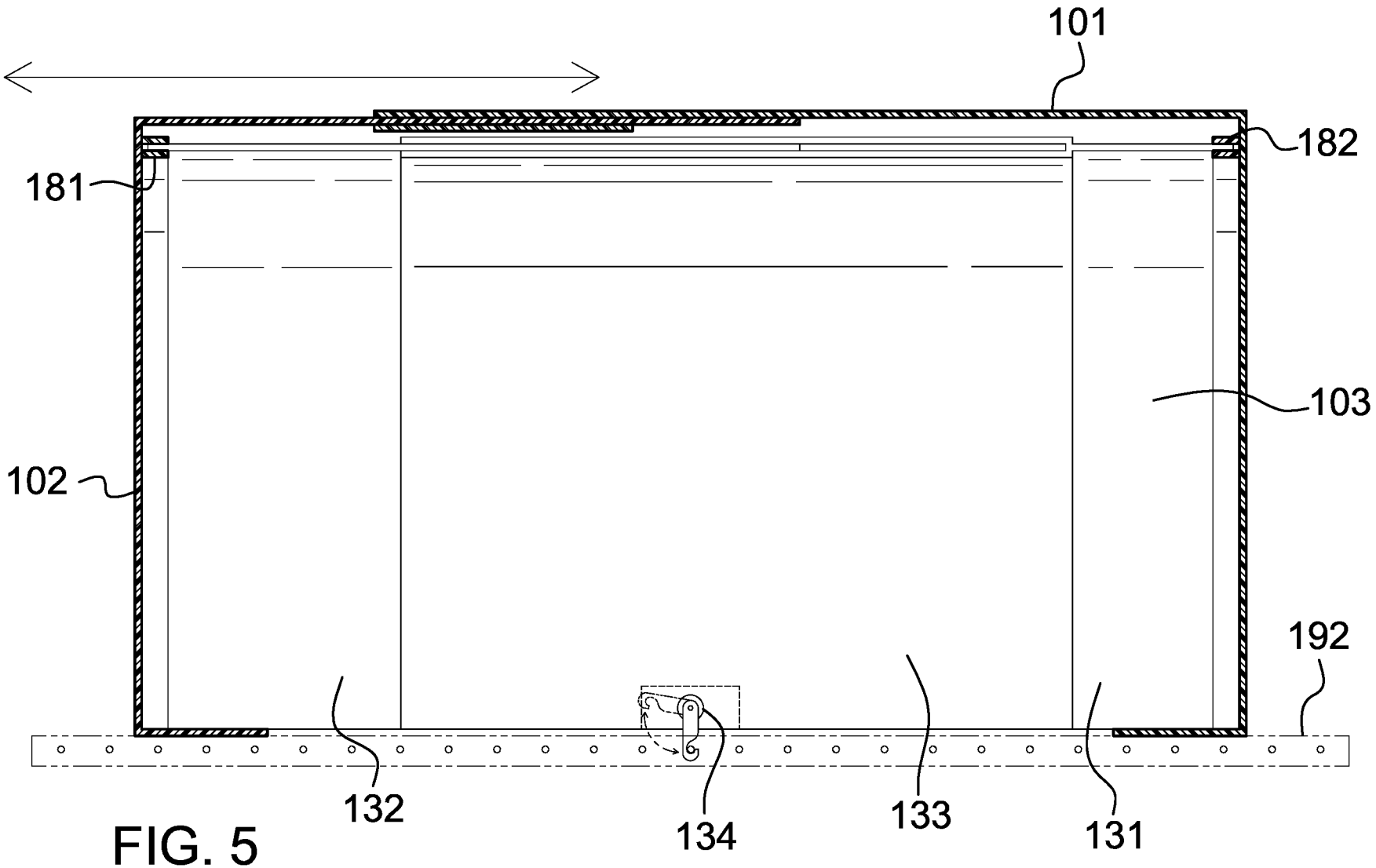
FIG. 5 is a cross-sectional view of an embodiment of the disclosure across 5-5 as shown in FIG. 3.
Figure 6:
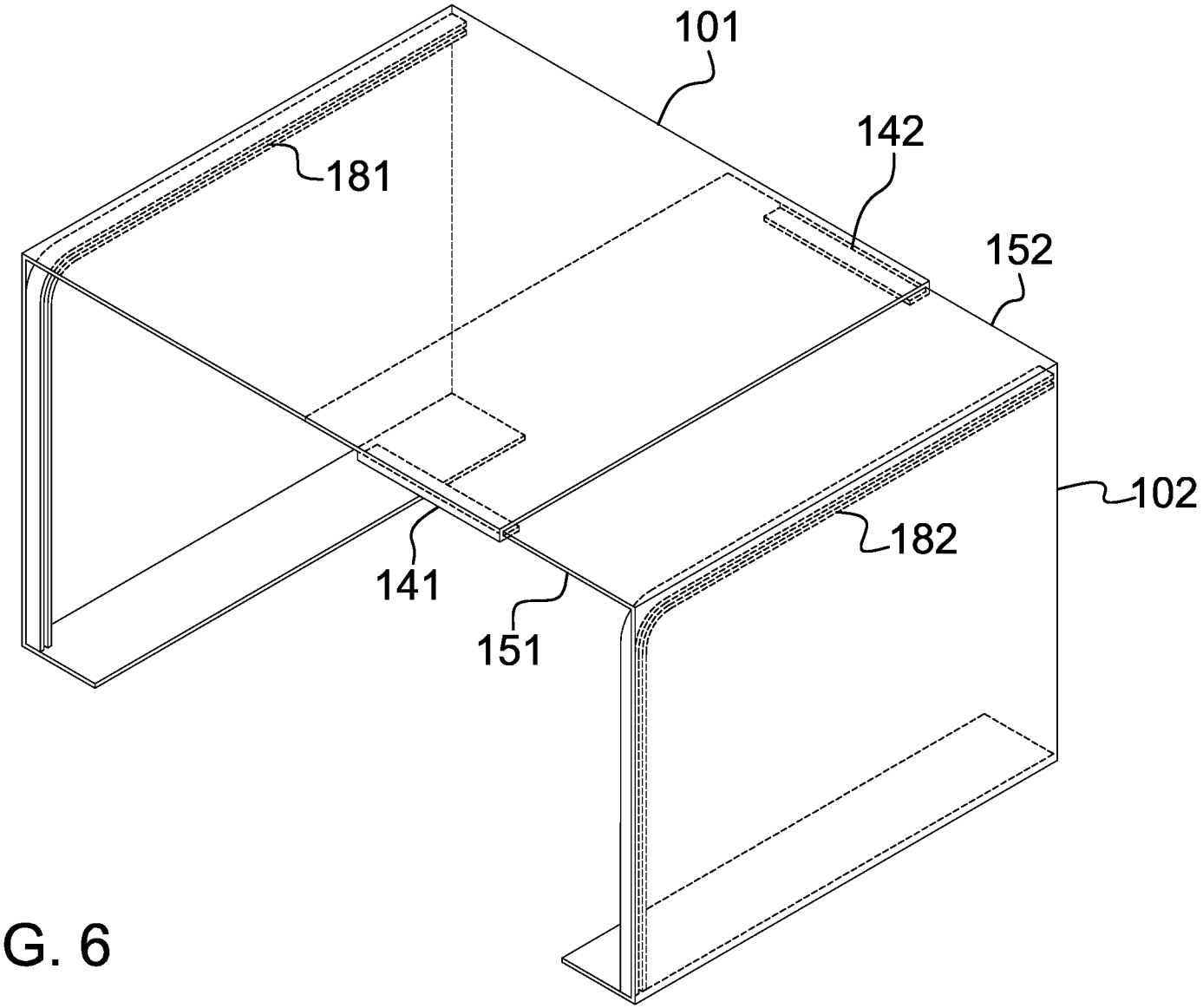
FIG. 6 is a detail view of an embodiment of the disclosure.
Figure 7:
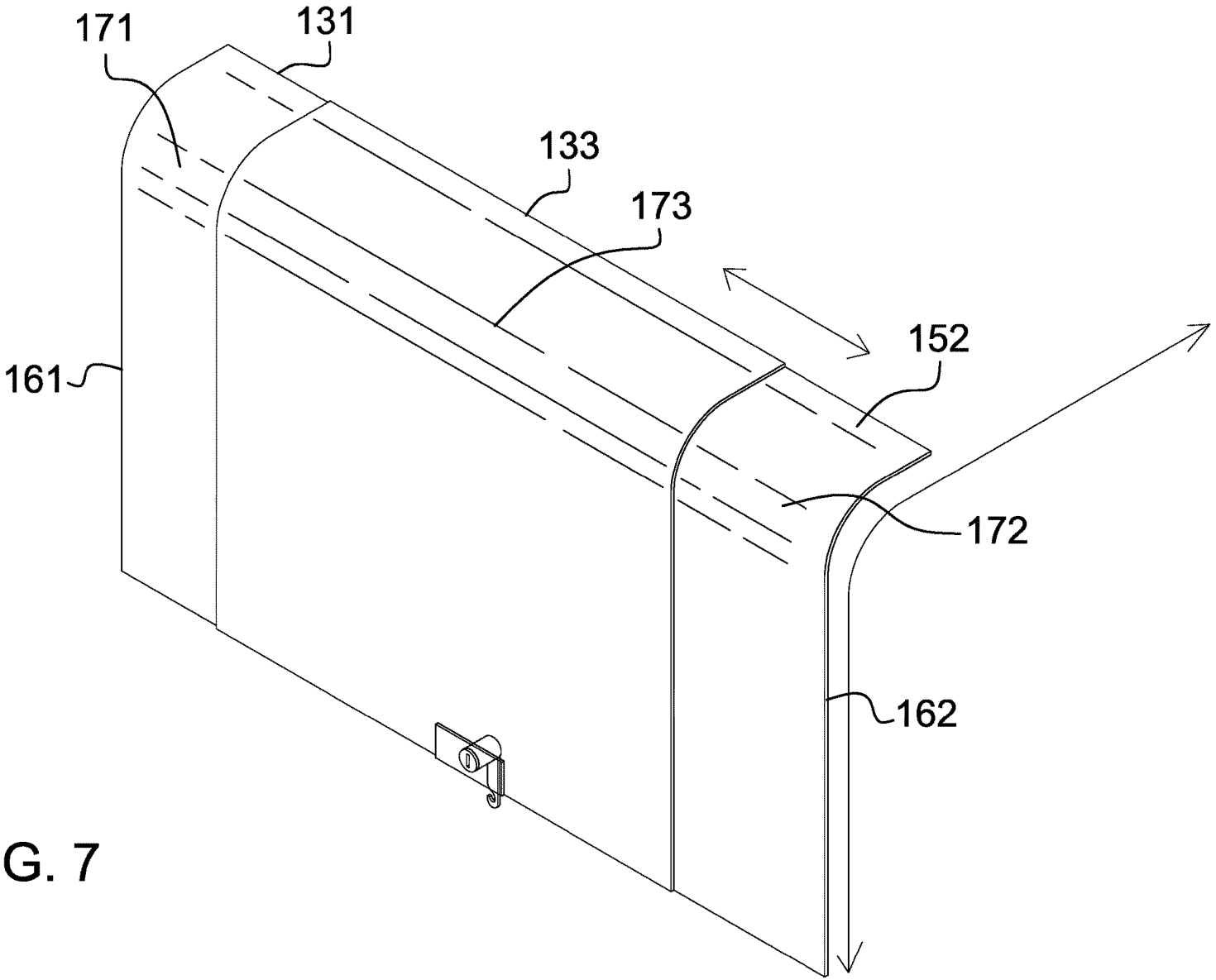
FIG. 7 is a detail view of an embodiment of the disclosure.

Detailed reference will now be made to one or more potential embodiments of the disclosure, which are illustrated in FIGS. 1 through 7.

The locking shelf insert for use with a refrigerator or freezer 100 (hereinafter invention) is a mechanical device. The invention 100 is configured for use with a storage device 191 selected from the group consisting of a refrigerator and a freezer. The selected storage device 191 further comprises a storage shelf 192. The invention 100 is a barrier structure that attaches to the storage shelf 192 of the selected device. The invention 100 is a lockable structure. The invention 100 forms a barricade that controls access into the storage space provided by the storage shelf 192 selected for attachment. The invention 100 comprises a first shell 101, a second shell 102, and a door structure 103. The first shell 101, the second shell 102, and the door structure 103 combine to form the barricade such that the form factor of the barricade is adjustable. The door structure 103 provides access into the protected storage space formed by the barricade.

The first shell 101 is a mechanical structure. The first shell 101 is a semi-rigid structure. The first shell 101 is a rigid structure. The first shell 101 forms a portion of the barricade formed by the invention 100. The first shell 101 is formed with all apertures and form factors necessary to allow the first shell 101 to accommodate the use and operation of the invention 100. Methods to form a first shell 101 suitable for the purposes described in this disclosure are well-known and documented in the mechanical arts.

The first shell 101 comprises a first superior plate 111 and a first vertical plate 112.

The first superior plate 111 is a disk-shaped structure. The first superior plate 111 is a rigid structure. The first superior plate 111 forms a horizontal surface of the barricade structure formed by the invention 100. The first superior plate 111 forms the superior structure of the first shell 101. The first superior plate 111 prevents access to the storage shelf 192 of the selected storage device 191 from the superior direction. The first superior plate 111 further comprises a first width track 141 and a second width track 142.

The first width track 141 is a track that is formed on a first edge on the first superior plate 111. The first width track 141 is formed on the concave inferior surface of the first superior plate 111. The first width track 141 is sized to receive the first width blade 151 of the second superior plate 121 of the second shell 102. The first width track 141 receives the first width blade 151 to attach the second superior plate 121 of the first shell 101. The first width track 141 receives the first width blade 151 such that the second shell 102 slides within the first shell 101.

The second width track 142 is a track that is formed on a second edge on the first superior plate 111. The second edge is distal from the first edge of the first superior plate 111. The second width track 142 is formed on the concave inferior surface of the first superior plate 111. The second width track 142 is sized to receive the second width blade 152 of the second superior plate 121 of the second shell 102. The second width track 142 receives the second width blade 152 to attach the second shell 102 of the first shell 101. The second width track 142 receives the second width blade 152 such that the second shell 102 slides within the first shell 101.

The form factor of the invention 100 adjusts by adjusting the position of the first width blade 151 within the first width track 141. The form factor of the invention 100 adjusts by adjusting the position of the second width blade 152 within the second width track 142. The first width blade 151 and the second width blade 152 are described elsewhere in this disclosure.

The first vertical plate 112 is a disk-shaped structure. The first vertical plate 112 is a rigid structure. The first vertical plate 112 forms a vertical surface of the barricade structure formed by the invention 100. The first vertical plate 112 prevents access to the storage shelf 192 of the selected storage device 191 from the side of the invention 100. The first vertical plate 112 attaches to the first superior plate 111 such that the first vertical plate 112 projects perpendicularly away from the first superior plate 111. The first vertical plate 112 raises the first superior plate 111 above the superior surface formed by the storage shelf 192 of the selected storage device 191 on which the invention 100 rests. The first vertical plate 112 further comprises a first vertical door track 143.

The first vertical door track 143 is a track that is formed on the congruent end of the disk structure of the first vertical plate 112 that is proximal to the second shell 102 and the first superior plate 111. The first vertical door track 143 is sized to receive the first vertical door blade 161 of the first door wing 131 such that the first door wing 131 of the door structure 103 will slide within and be guided by the first vertical door track 143 as the door structure 103 moves between the closed position and the open position. The first vertical door blade is described elsewhere in this disclosure.

The second shell 102 is a mechanical structure. The second shell 102 is a semi-rigid structure. The second shell 102 is a rigid structure. The second shell 102 forms a portion of the barricade formed by the invention 100. The second shell 102 is formed with all apertures and form factors necessary to allow the second shell 102 to accommodate the use and operation of the invention 100. Methods to form a second shell 102 suitable for the purposes described in this disclosure are well-known and documented in the mechanical arts.

The second shell 102 is geometrically similar to the first shell 101 such that the first shell 101 inserts into the second shell 102. The second shell 102 inserts into the first shell 101 in a telescopic fashion. The span of the length of the invention 100 adjusts by adjusting the position of the second shell 102 relative to the first shell 101.

The second shell 102 comprises a second superior plate 121 and a second vertical plate 122.

The second superior plate 121 is a disk-shaped structure. The second superior plate 121 is a rigid structure. The second superior plate 121 forms a horizontal surface of the barricade structure formed by the invention 100. The second superior plate 121 forms the superior structure of the second shell 102. The second superior plate 121 prevents access to the storage shelf 192 of the selected storage device 191 from the superior direction. The second superior plate 121 further comprises a first width blade 151 and a second width blade 152.

The first width blade 151 is a lateral face of the disk structure that forms the second superior plate 121 of the second shell 102. The first width blade 151 is the edge of the second superior plate 121 that inserts into the first width track 141 of the first superior plate 111 such that the second superior plate 121 slides into and out of the first superior plate 111.

The second width blade 152 is a lateral face of the disk structure that forms the second superior plate 121 of the second shell 102. The second width blade 152 is the edge of the second superior plate 121 that inserts into the second width track 142 of the first superior plate 111 such that the second superior plate 121 slides into and out of the first superior plate 111. The second width blade 152 is the edge of the second superior plate 121 that is distal from the first width blade 151.

The second vertical plate 122 is a disk-shaped structure. The second vertical plate 122 is a rigid structure. The second vertical plate 122 forms a vertical surface of the barricade structure formed by the invention 100. The second vertical plate 122 prevents access to the storage shelf 192 of the selected storage device 191 from the side of the invention 100. The second vertical plate 122 attaches to the second superior plate 121 such that the second vertical plate 122 projects perpendicularly away from the second superior plate 121. The second vertical plate 122 raises the second superior plate 121 above the superior surface formed by the storage shelf 192 of the selected storage device 191 on which the invention 100 rests. The second vertical plate 122 further comprises a second vertical door track 153.

The second vertical door track 153 is a track that is formed on the congruent end of the disk structure of the second vertical plate 122 that is proximal to the second shell 102 and the first superior plate 111. The second vertical door track 153 is sized to receive the second vertical door blade 162 of the second door wing 132 such that the second door wing 132 of the door structure 103 will slide within and be guided by the second vertical door track 153 as the door structure 103 moves between the closed position and the open position. The second vertical door blade 162 is described elsewhere in this disclosure.

The door structure 103 is a mechanical structure. The door structure 103 is a semi-rigid structure. The door structure 103 is a flexible structure. The door structure 103 forms a portion of the barricade formed by the invention 100. The door structure 103 is formed with all apertures and form factors necessary to allow the door structure 103 to accommodate the use and operation of the invention 100. Methods to form a door structure 103 suitable for the purposes described in this disclosure are well-known and documented in the mechanical arts.

The door structure 103 attaches to both the first shell 101 and the second shell 102. The position of the door structure 103 relative to both the first shell 101 and the second shell 102 is adjustable.

The door structure 103 provides access through the barricade formed by the invention 100 to the storage shelf 192 of the selected storage device 191 on which the invention 100 rests. The door structure 103 moves between a closed position and an open position. The door structure 103 slides in the vertical direction to move between the closed position and the open position.

The door structure 103 is a locking structure. The door structure 103 fastens directly to the storage shelf 192 of the selected storage device 191 in the closed position. The door structure 103 locks to the storage shelf 192 of the selected storage device 191 when in the closed position.

The door structure 103 comprises a first door wing 131, a second door wing 132, and a door plate 133.

The first door wing 131 is a non-Euclidean disk structure. The first door wing 131 is a semi-rigid structure. The first door wing 131 is a flexible structure. The first door wing 131 attaches to the door plate 133. The first door wing 131 attaches to the first superior plate 111. The first door wing 131 attaches to the door plate 133 such that the position of the first door wing 131 relative to the door plate 133 is adjustable. The first door wing 131 is a curved structure.

The first door wing 131 further comprises a first vertical door blade 161, a third horizontal door blade 163, and a first kerf bending 171.

The first kerf bending 171 is a flexure bearing that allows the first door wing 131 to bend into the non-Euclidean disk structure of the first door wing 131 as the invention 100 moves between the closed position and the open position. The first door wing 131 is formed with the first kerf bending 171. The first kerf bending 171 is a form of a living hinge that is defined elsewhere in this disclosure. The first kerf bending 171 of the first door wing 131 is formed such that the first door wing 131 will bend as the door structure 103 is raised to fit underneath the structure formed by the first shell 101 and the second shell 102. The first door wing 131 bends underneath the first shell 101 and the second shell 102 such that the first door wing 131 forms a vertical portion of the barricade formed by the invention 100.

The first vertical door blade 161 is a lateral face of the non-Euclidean disk structure that forms the first door wing 131. The first vertical door blade 161 is the edge of the first door wing 131 that inserts into the first vertical door track 143 of the first superior plate 111 such that the first door wing 131 slides between the closed position and the open position of the invention 100.

The third horizontal door blade 163 is a lateral face of the non-Euclidean disk structure that forms the first door wing 131. The third horizontal door blade 163 forms the edge of the first door wing 131 between the first vertical door blade 161 and the second vertical door blade 162.

The second door wing 132 is a non-Euclidean disk structure. The second door wing 132 is a semi-rigid structure. The second door wing 132 is a flexible structure. The second door wing 132 attaches to the door plate 133. The second door wing 132 attaches to the first vertical plate 112. The second door wing 132 attaches to the door plate 133 such that the position of the second door wing 132 relative to the door plate 133 is adjustable. The second door wing 132 is a curved structure.

The second door wing 132 further comprises a second vertical door blade 162, a fourth horizontal door blade 164, and a second kerf bending 172.

The second kerf bending 172 is a flexure bearing that allows the second door wing 132 to bend into the non-Euclidean disk structure of the second door wing 132 as the invention 100 moves between the closed position and the open position. The second door wing 132 is formed with the second kerf bending 172. The second kerf bending 172 is a form of a living hinge that is defined elsewhere in this disclosure. The second kerf bending 172 of the second door wing 132 is formed such that the second door wing 132 will bend as the door structure 103 is raised to fit underneath the structure formed by the first shell 101 and the second shell 102. The second door wing 132 bends underneath the first shell 101 and the second shell 102 such that the second door wing 132 forms a vertical portion of the barricade formed by the invention 100.

The second vertical door blade 162 is a lateral face of the non-Euclidean disk structure that forms the second door wing 132. The second vertical door blade 162 is the edge of the second door wing 132 that inserts into the second vertical door track 153 of the first vertical plate 112 such that the second door wing 132 slides between the closed position and the open position of the invention 100.

The fourth horizontal door blade 164 is a lateral face of the non-Euclidean disk structure that forms the second door wing 132. The fourth horizontal door blade 164 forms the edge of the second door wing 132 between the first vertical door blade 161 and the second vertical door blade 162.

The door plate 133 is a non-Euclidean disk structure. The door plate 133 is a semi-rigid structure. The door plate 133 is a flexible structure. The door plate 133 attaches to the first door wing 131 such that the first door wing 131 adjusts horizontally relative to the door plate 133. The door plate 133 attaches to the second door wing 132 such that the second door wing 132 adjusts horizontally relative to the door plate 133. The ability to adjust the form factor of the door structure 103 by adjusting the positions of the first door wing 131 and the second door wing 132 relative to the door plate 133 such that the invention 100 encloses the front access into the storage shelf 192 of the selected storage device 191. The door plate 133 is a curved structure.

The door plate 133 further comprises a third kerf bending 173, a first horizontal door track 181, and a second horizontal door track 182.

The third kerf bending 173 is a flexure bearing that allows the door plate 133 to bend into the non-Euclidean disk structure of the door plate 133 as the invention 100 moves between the closed position and the open position. The door plate 133 is formed with the third kerf bending 173. The third kerf bending 173 is a form of a living hinge that is defined elsewhere in this disclosure. The third kerf bending 173 of the door plate 133 is formed such that the door plate 133 will bend as the door structure 103 is raised to fit underneath the structure formed by the first shell 101 and the second shell 102. The first door wing 131, the second door wing 132, and the door plate 133 move and bend simultaneously as the door structure 103 moves vertically between the closed position and the open position.

The first horizontal door track 181 forms a track into which the third horizontal door blade 163 slides. The first horizontal door track 181 is formed on the concave interior surface of the door plate 133. The width of the door structure across the selected storage device 191 adjusts by adjusting the position of the third horizontal door blade 163 within the first horizontal door track 181.

The second horizontal door track 182 forms a track into which the fourth horizontal door blade 164 slides. The second horizontal door track 182 is formed on the interior surface of the door plate 133. The width of the door structure 103 across the selected storage device 191 adjusts by adjusting the position of the fourth horizontal door blade 164 within the second horizontal door track 182.

The door plate 133 further comprises a locking mechanism 134. The locking mechanism 134 locks the door structure 103 to the storage shelf 192 of the selected storage device 191 when the invention 100 is in the closed position. The locking mechanism 134 is a commercially available device. The use of a locking mechanism 134 is well-known and documented in the mechanical arts. In the first potential embodiment of the disclosure, the locking mechanism 134 secures the door structure 103 to a bar of the storage shelf 192 of the selected storage device 191.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Barricade: As used in this disclosure, a barricade is a mechanical structure that forms a barrier that prevents the passage of a person or an object across the boundary formed by the barricade.

Barrier: As used in this disclosure, a barrier is a physical obstacle that forms a boundary between a first space and a second space. The barrier prevents the passage of an object between the first space and the second space.

Blade: As used in this disclosure, a blade is a term that is used to describe: 1) a wide and flat portion of a structure; or, 2) the cutting edge of a tool.

Closed Position: As used in this disclosure, a closed position refers to a movable barrier structure that is in an orientation that prevents passage through a port or an aperture. The closed position is often referred to as an object being "closed."

Concave: As used in this disclosure, concave is used to describe: 1) a surface that resembles the interior surface of a sphere; or, 2) a function with a curvature structure wherein a chord that connects any two points of the function will be lesser than (graphically below) or equal to the value of the function at any point along the chord.

Convex: As used in this disclosure, convex is used to describe: 1) a surface that resembles the outer surface of a sphere; or, 2) a function with a curvature structure wherein a chord that connects any two points of the function will be greater than (graphically above) or equal to the value of the function at any point along the chord.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Flexible: As used in this disclosure, flexible refers to an object or material that will deform when a force is applied to it but that will not necessarily return to its original shape when the deforming force is removed.

Flexure Bearing: As used in this disclosure, a flexure bearing is a thin and flexible material that is used to attach, or bind, a first object to a second object such that the first object can rotate in a controlled direction relative to the second object.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. Always use Correspond and One to One Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Living Hinge: As used in this disclosure, refers to a single object that is formed out of elastomeric material that is divided into a first segment, a second segment and the living hinge. The elastic nature of the elastomeric material allow the living hinge to be flexed in the manner of a hinge allowing the first segment to rotate relative to the second hinge. The living hinge is a form of a flexure bearing. A material that is formed with a series of parallel living hinges is referred to as a kerf bending. A kerf bending formed in a plate allows the plate to be bent into a curved shape.

Lock: As used in this disclosure, a lock is a device that prevents the unauthorized entry into a container or chamber.

Non-Euclidean Disk: As used in this disclosure, a non-Euclidean structure is a disk-shaped structure wherein the congruent end (faces) of the disk structure lies on a non-Euclidean plane.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Open Position: As used in this disclosure, an open position refers to a movable barrier structure that is in an orientation that allows passage through a port or an aperture. The open position is often referred to as an object being "open."

Orientation: As used in this disclosure, orientation refers to the positioning of a first object relative to: 1) a second object; or, 2) a fixed position, location, or direction.

Plate: As used in this disclosure, a plate is a smooth, flat and semi-rigid or rigid structure that has at least one dimension that: a) is of uniform thickness; and b) that appears thin relative to the other dimensions of the object. Plates often have a rectangular appearance. Plates often have a disk-like structure. The face of the plate is a surface of the plate selected from the group consisting of: a) the surface of the plate with the greatest surface area; b) the surface of the plate that is distal from the surface of the plate with the greatest surface area. The edges of the plate comprises the surfaces of the plate that would not be considered faces as defined above. As defined in this disclosure, plates may be made of any material, but are commonly made of metal, plastic, and wood. When made of wood, a plate is often referred to as a board or a plank.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Rigid Structure: As used in this disclosure, a rigid structure is a solid structure formed from an inelastic material that resists changes in shape. A rigid structure will permanently deform as it fails under a force.

Semi-Rigid Structure: As used in this disclosure, a semi-rigid structure is a solid structure that is stiff but not wholly inflexible and that will deform under force before breaking. A semi-rigid structure may or may not behave with an elastic nature in that a semi-rigid structure need not return to its relaxed shape.

Shell: As used in this disclosure, a shell is a structure that forms an outer covering intended to contain an object. Shells are often, but not necessarily, rigid or semi-rigid structures that are intended to protect the object contained within it.

Superior: As used in this disclosure, the term superior refers to a directional reference that is parallel to and in the opposite direction of the force of gravity when an object is positioned or used normally.

Telescopic: As used in this disclosure, telescopic is an adjective that describes an object made of sections that fit or slide into each other such that the object can be made longer or shorter by adjusting the relative positions of the sections.

Track: As used in this disclosure, a track is a structural relationship between a first object and a second object that serves a purpose selected from the group consisting of: 1) fastening the second object to the first object; 2) controlling the path of motion of the first object relative to the second object in at least one dimension and in a maximum of two dimensions; or, 3) a combination of the first two elements of this group.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A locking shelf insert comprising a first shell, a second shell, and a door structure;

wherein the first shell, the second shell, and the door structure combine to form a barricade;

wherein the barricade is adjustable;

wherein the locking shelf insert is a mechanical device;

wherein the locking shelf insert is configured for use with a storage device selected from the group consisting of a refrigerator and a freezer;

wherein the selected storage device further comprises a storage shelf;

wherein the locking shelf insert attaches to the storage shelf of the selected device;

wherein the locking shelf insert is a lockable structure;

wherein the door structure provides access into a protected storage space formed by the barricade;

wherein the door structure is a mechanical structure;

wherein the door structure is a semi-rigid structure;

wherein the door structure is a flexible structure;

wherein the door structure forms a portion of the barricade formed by the locking shelf insert;

wherein the door structure attaches to both the first shell and the second shell;

wherein the position of the door structure relative to both the first shell and the second shell is adjustable;

wherein the second shell is geometrically similar to the first shell such that the second shell inserts into the first shell in a telescopic fashion;

wherein the span of the length of the locking shelf insert adjusts by adjusting the position of the second shell relative to the first shell;

wherein the door structure provides access through the barricade formed by the locking shelf insert to the storage shelf of the selected storage device on which the locking shelf insert rests;

wherein the door structure moves between a closed position and an open position;

wherein the door structure slides in the vertical direction to move between the closed position and the open position;

wherein the door structure is a locking structure;

wherein the door structure fastens directly to the storage shell of the selected storage device in the closed position;

wherein the door structure locks to the storage shell of the selected storage device when in the closed position.

2. The locking shelf insert according to claim 1 wherein the first shell is a mechanical structure;

wherein the first shell forms a portion of the barricade formed by the locking shelf insert.

3. The locking shelf insert according to claim 2 wherein the second shell is a mechanical structure;

wherein the second shell forms a portion of the barricade formed by the locking shelf insert.

4. The locking shelf insert according to claim 3 wherein the first shell comprises a first superior plate and a first vertical plate;

wherein the first vertical plate attaches to the first superior plate such that the first vertical plate projects perpendicularly away from the first superior plate.

5. The locking shelf insert according to claim 4 wherein the second shell comprises a second superior plate and a second vertical plate;

wherein the second vertical plate attaches to the second superior plate such that the second vertical plate projects perpendicularly away from the second superior plate.

6. The locking shelf insert according to claim 5 wherein the door structure comprises a first door wing, a second door wing, and a door plate;

wherein the first door wing attaches to the door plate such that the position of the first door wing relative to the door plate is adjustable;

wherein the second door wing attaches to the door plate such that the position of the second door wing relative to the door plate is adjustable.

7. The locking shelf insert according to claim 6 wherein the first superior plate is a disk-shaped structure;

wherein the first superior plate is a rigid structure;

wherein the first superior plate forms a horizontal surface of the barricade structure formed by the locking shelf insert;

wherein the first superior plate forms the superior structure of the first shell;

wherein the first superior plate prevents access to the storage shelf of the selected storage device from the superior direction;

wherein the first vertical plate is a disk-shaped structure;

wherein the first vertical plate is a rigid structure;

wherein the first vertical plate forms a vertical surface of the barricade structure formed by the locking shelf insert;

wherein the first vertical plate prevents access to the storage shelf of the selected storage device from the side of the locking shelf insert;

wherein the first vertical plate raises the first superior plate above the superior surface formed by the storage shelf of the selected storage device on which the locking shelf insert rests.

8. The locking shelf insert according to claim 7 wherein the second superior plate is a disk-shaped structure;

wherein the second superior plate is a rigid structure;

wherein the second superior plate forms a horizontal surface of the barricade structure formed by the locking shelf insert;

wherein the second superior plate forms the superior structure of the second shell;

wherein the second superior plate prevents access to the storage shelf of the selected storage device from the superior direction;

wherein the second vertical plate is a disk-shaped structure;

wherein the second vertical plate is a rigid structure;

wherein the second vertical plate forms a vertical surface of the barricade structure formed by the locking shelf insert;

wherein the second vertical plate prevents access to the storage shelf of the selected storage device from the side of the locking shelf insert;

wherein the second vertical plate raises the second superior plate above the superior surface formed by the storage shelf of the selected storage device on which the locking shelf insert rests.

9. The locking shelf insert according to claim 8 wherein the door plate is a non-Euclidean disk structure;

wherein the door plate is a semi-rigid structure;

wherein the door plate is a flexible structure;

wherein the door plate is a curved structure.

10. The locking shelf insert according to claim 9 wherein the first superior plate further comprises a first width track and a second width track;

wherein the first width track is a track that is formed on a first edge on the first superior plate;

wherein the first width track is formed on the concave inferior surface of the first superior plate;

wherein the second width track is a track that is formed on a second edge on the first superior plate;

wherein the second edge is distal from the first edge of the first superior plate;

wherein the second width track is formed on the concave inferior surface of the first superior plate;

wherein the first vertical plate further comprises a first vertical door track;

wherein the first vertical door track is a track that is formed on the congruent end of the disk structure of the first vertical plate that is proximal to the second shell and the first superior plate.

11. The locking shelf insert according to claim 10 wherein the second superior plate further comprises a first width blade and a second width blade;

wherein the first width blade is a lateral face of the disk structure that forms the second superior plate of the second shell;

wherein the first width blade is the edge of the second superior plate that inserts into the first width track of the first superior plate such that the second superior plate slides into and out of the first superior plate;

wherein the second width blade is a lateral face of the disk structure that forms the second superior plate of the second shell;

wherein the second width blade is the edge of the second superior plate that inserts into the second width track of the first superior plate such that the second superior plate slides into and out of the first superior plate;

wherein the second width blade is the edge of the second superior plate that is distal from the first width blade;

wherein the second vertical plate further comprises a second vertical door track;

wherein the second vertical door track is a track that is formed on the congruent end of the disk structure of the second vertical plate that is proximal to the second shell and the first superior plate.

12. The locking shelf insert according to claim 11 wherein the first door wing is a non-Euclidean disk structure;

wherein the first door wing is a semi-rigid structure;

wherein the first door wing is a flexible structure;

wherein the first door wing attaches to the door plate;

wherein the first door wing attaches to the first superior plate;

wherein the first door wing is a curved structure;

wherein the first door wing further comprises a first vertical door blade, a third horizontal door blade, and a first kerf bending;

wherein the first kerf bending is a flexure bearing that allows the first door wing to bend into the non-Euclidean disk structure of the first door wing as the locking shelf insert moves between the closed position and the open position;

wherein the first door wing is formed with the first kerf bending;

wherein the first kerf bending is a form of a living hinge that is defined elsewhere in this disclosure;

wherein the first kerf bending of the first door wing is formed such that the first door wing will bend as the door structure is raised to fit underneath the structure formed by the first shell and the second shell;

wherein the first door wing bends underneath the first shell and the second shell such that the first door wing forms a vertical portion of the barricade formed by the locking shelf insert;

wherein the first vertical door blade is a lateral face of the non-Euclidean disk structure that forms the first door wing;

wherein the first vertical door blade is the edge of the first door wing that inserts into the first vertical door track of the first superior plate such that the first door wing slides between the closed position and the open position of the locking shelf insert;

wherein the third horizontal door blade is a lateral face of the non-Euclidean disk structure that forms the first door wing;

wherein the third horizontal door blade forms the edge of the first door wing between the first vertical door blade and the second vertical door blade.

13. The locking shelf insert according to claim 12 wherein the second door wing is a non-Euclidean disk structure;

wherein the second door wing is a semi-rigid structure;

wherein the second door wing is a flexible structure;

wherein the second door wing attaches to the door plate;

wherein the second door wing attaches to the first vertical plate;

wherein the second door wing is a curved structure;

wherein the second door wing further comprises a second vertical door blade, a fourth horizontal door blade, and a second kerf bending;

wherein the second kerf bending is a flexure bearing that allows the second door wing to bend into the non-Euclidean disk structure of the second door wing as the locking shelf insert moves between the closed position and the open position;

wherein the second door wing is formed with the second kerf bending;

wherein the second kerf bending is a form of a living hinge that is defined elsewhere in this disclosure;

wherein the second kerf bending of the second door wing is formed such that the second door wing will bend as the door structure is raised to fit underneath the structure formed by the first shell and the second shell;

wherein the second door wing bends underneath the first shell and the second shell such that the second door wing forms a vertical portion of the barricade formed by the locking shelf insert;

wherein the second vertical door blade is a lateral face of the non-Euclidean disk structure that forms the second door wing;

wherein the second vertical door blade is the edge of the second door wing that inserts into the second vertical door track of the first vertical plate such that the second door wing slides between the closed position and the open position of the locking shelf insert;

wherein the fourth horizontal door blade is a lateral face of the non-Euclidean disk structure that forms the second door wing;

wherein the fourth horizontal door blade forms the edge of the second door wing between the first vertical door blade and the second vertical door blade.

14. The locking shelf insert according to claim 13 wherein the door plate further comprises a third kerf bending, a first horizontal door track, and a second horizontal door track;

wherein the third kerf bending is a flexure bearing that allows the door plate to bend into the non-Euclidean disk structure of the door plate as the locking shelf insert moves between the closed position and the open position;

wherein the door plate is formed with the third kerf bending;

wherein the third kerf bending is a form of a living hinge that is defined elsewhere in this disclosure;

wherein the third kerf bending of the door plate is formed such that the door plate will bend as the door structure is raised to fit underneath the structure formed by the first shell and the second shell;

wherein the first door wing, the second door wing, and the door plate move and bend simultaneously as the door structure moves vertically between the closed position and the open position;

wherein the first horizontal door track forms a track into which the third horizontal door blade slides;

wherein the first horizontal door track is formed on the concave interior surface of the door plate;

wherein the width of the door structure across the selected storage device adjusts by adjusting the position of the third horizontal door blade within the first horizontal door track;

wherein the second horizontal door track forms a track into which the fourth horizontal door blade slides;

wherein the second horizontal door track is formed on the interior surface of the door plate;

wherein the width of the door structure across the selected storage device adjusts by adjusting the position of the fourth horizontal door blade within the second horizontal door track;

wherein the door plate further comprises a locking mechanism;

wherein the locking mechanism locks the door structure to the storage shelf of the selected storage device when the locking shelf insert is in the closed position.

15. The locking shelf insert according to claim 14 wherein the first width track is sized to receive the first width blade of the second superior plate of the second shell;

wherein the first width track receives the first width blade to attach the second superior plate of the first shell;

wherein the first width track receives the first width blade such that the second shell slides within the first shell;

wherein the second width track is sized to receive the second width blade of the second superior plate of the second shell;

wherein the second width track receives the second width blade to attach the second shell of the first shell;

wherein the second width track receives the second width blade such that the second shell slides within the first shell;

wherein the form factor of the locking shelf insert adjusts by adjusting the position of the first width blade within the first width track;

wherein the form factor of the locking shelf insert adjusts by adjusting the position of the second width blade within the second width track;

wherein the second vertical door track is sized to receive the second vertical door blade of the second door wing such that the second door wing of the door structure will slide within and be guided by the second vertical door track as the door structure moves between the closed position and the open position;

wherein the first vertical door track is sized to receive the first vertical door blade of the first door wing such that the first door wing of the door structure will slide within and be guided by the first vertical door track as the door structure moves between the closed position and the open position.

* * * * *